US011160436B2

(12) United States Patent
Olson

(10) Patent No.: US 11,160,436 B2
(45) Date of Patent: Nov. 2, 2021

(54) DISHWARE DRYING RACK AND METHOD OF DIRECTING AND COLLECTING WATER

(71) Applicant: INTERMETRO INDUSTRIES CORPORATION, Wilkes-Barre, PA (US)

(72) Inventor: Jeffrey C. Olson, Dallas, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 0 days.

(21) Appl. No.: 16/741,879

(22) Filed: Jan. 14, 2020

(65) Prior Publication Data

US 2020/0229676 A1 Jul. 23, 2020

Related U.S. Application Data

(60) Provisional application No. 62/793,430, filed on Jan. 17, 2019.

(51) Int. Cl.

| | |
|---|---|
| ***A47L 19/04*** | (2006.01) |
| ***A47L 19/02*** | (2006.01) |
| *A47B 57/54* | (2006.01) |

(52) U.S. Cl.

CPC ..... *A47L 19/04* (2013.01); *A47L 19/02* (2013.01); *A47B 57/54* (2013.01)

(58) Field of Classification Search

CPC ..... A47L 19/00; A47L 19/02; A47L 19/04; A47L 23/20

See application file for complete search history.

(56) References Cited

U.S. PATENT DOCUMENTS

| | | | | |
|---|---|---|---|---|
| 43,088 A * | 6/1864 | Britain | ..... | A47L 19/04 220/572 |
| 115,344 A * | 5/1871 | Neefus | ..... | A47L 19/04 211/41.3 |
| 124,085 A * | 2/1872 | Richmond | ..... | A47L 19/04 211/41.3 |

(Continued)

FOREIGN PATENT DOCUMENTS

| | | | | |
|---|---|---|---|---|
| CH | 162108 A * | 6/1933 | ..... | A47L 19/02 |
| CH | 585537 A5 * | 3/1977 | ..... | A47G 23/06 |

(Continued)

OTHER PUBLICATIONS

MetroMax i(R) Drying Rack; circa. 2018.

*Primary Examiner* — Stanton L Krycinski

(74) *Attorney, Agent, or Firm* — Harness, Dickey & Pierce, P.L.C.

(57) ABSTRACT

A drying rack for collecting water from one or more pieces of dishware includes a frame and a support shelf removably positioned on the frame. The support shelf is configured for supporting the one or more pieces of dishware. The drying rack also includes a drip tray removably supported by the frame below the support shelf. The drip tray includes a guide surface and defines a drain opening, wherein the guide surface is angled toward the drain opening to guide water toward the drain opening. The drying rack also includes a drip pan bracket supported by the frame. The drip pan bracket includes a pair of pan rails configured to removably receive and position a drip pan below the drain opening to collect the water guided by the guide surface through the drain opening.

23 Claims, 9 Drawing Sheets

(56) References Cited

U.S. PATENT DOCUMENTS 497,673 A * 5/1893 Lyle ..... A47L 19/04 220/572
1,742,150 A * 12/1929 Rollins ..... A47L 19/04 217/21
2,247,932 A * 7/1941 Wexler ..... A47L 19/04 211/41.3
2,635,027 A * 4/1953 Rasmussen ..... A47L 19/04 312/229
4,531,641 A * 7/1985 Archambault ..... A47L 19/02 211/208
4,798,307 A * 1/1989 Evrard ..... A47L 13/58 15/264
4,799,744 A * 1/1989 Toy ..... A47J 47/16 211/184
5,184,749 A * 2/1993 Attenasio ..... A47L 13/51 15/257.01
6,119,736 A * 9/2000 Huang ..... B62B 3/006 141/86
6,491,170 B1 * 12/2002 Madela ..... A47L 19/04 211/41.3
7,325,695 B2 * 2/2008 Yang ..... A47L 19/04 211/41.2
7,748,543 B2 * 7/2010 Yang ..... A47L 19/04 211/41.3
7,766,174 B2 * 8/2010 Abraitis ..... A47L 23/20 211/36
8,074,813 B2 * 12/2011 Yang ..... A47L 19/04 211/41.3
8,794,455 B2 * 8/2014 Yang ..... A47L 19/04 211/41.3
8,925,742 B1 * 1/2015 Chitayat ..... A47L 19/04 211/41.6
9,364,084 B2 * 6/2016 Rege ..... A47G 25/12
9,649,010 B2 * 5/2017 Oh ..... A47L 19/04
10,271,710 B2 * 4/2019 Wegner ..... A47L 19/04
10,835,101 B2 * 11/2020 Singh ..... A47L 11/4002
2004/0099617 A1 * 5/2004 Elias ..... A47L 19/04 211/41.3
2010/0059460 A1 * 3/2010 Mulaw ..... A47L 19/04 211/41.3
2012/0151789 A1 * 6/2012 Hurst ..... F26B 9/066 34/202
2020/0237182 A1 * 7/2020 Klug ..... A47L 19/02

FOREIGN PATENT DOCUMENTS

DE 414617 C * 6/1925 ..... A47L 19/02
DE 706307 C * 5/1941 ..... A47L 19/04
FR 935821 A * 7/1948 ..... A47L 19/04
GB 397273 A * 8/1933 ..... A47L 19/04
GB 428983 A * 5/1935 ..... A47L 19/02
GB 2047395 A * 11/1980 ..... A47L 19/02

* cited by examiner

DISHWARE DRYING RACK AND METHOD OF DIRECTING AND COLLECTING WATER

CROSS-REFERENCE TO RELATED APPLICATIONS

This application claims the benefit of U.S. Provisional Application No. 62/793,430, filed on Jan. 17, 2019. The entire disclosure of the above application is incorporated herein by reference.

FIELD

The present disclosure relates to dishware drying racks and methods of directing and collecting water.

BACKGROUND

This section provides background information related to the present disclosure which is not necessarily prior art.

Commercial drying racks and drying rack systems are commonly used in food service environments to support a variety of items for air-drying after cleaning. Dishware is one such item that can be supported on a drying rack after cleaning to permit excess rinse water to drain off of the dishware and/or to evaporate from the dishware. As used herein, dishware can include any item used during food service or food preparation such as, for example, pots, pans, trays, bowls, storage containers, preparation containers, utensils, plates, knives, appliances and the like. Such drying racks and drying rack assemblies have found widespread use in industrial, commercial and residential applications.

Many drying racks and drying rack assemblies support the dishware in an elevated position and allow the water to drain from the dishware onto the surface that supports the drying rack. In many instances, the drying racks are placed on or near a sink or are positioned over or near a floor drain. The water that drains from the dishware in these instances collects and/or flows on the surfaces supporting the drying racks before flowing into the drain. Thus, water can collect on the floor and create an undesirable condition, such as a slip hazard for workers that may be working in the vicinity of the drying racks. Further, the surfaces supporting the drying racks may require repeated cleanings to maintain clean, dry and safe working environments.

SUMMARY

This section provides a general summary of the disclosure, and is not a comprehensive disclosure of its full scope or all of its features.

In one example in accordance with the principles of the present disclosure, a drying rack for collecting water from one or more pieces of dishware is provided. The drying rack may include a frame and a support shelf removably positioned on the frame. The support shelf is configured for supporting the one or more pieces of dishware. The drying rack may also include a drip tray removably supported by the frame below the support shelf. The drip tray includes a guide surface and defines a drain opening, wherein the guide surface is angled toward the drain opening to guide water toward the drain opening. The drying rack may also include a drip pan bracket supported by the frame. The drip pan bracket may include a pair of pan rails configured to removably receive and position a drip pan below the drain opening to collect the water guided by the guide surface through the drain opening.

In one aspect, the frame may include a rail ledge projecting inwardly from an inner surface thereof, wherein the drip pan bracket includes at least one retention arm with a rail engagement tab and the rail engagement tab engages the rail ledge to support the drip pan bracket on the frame.

In another aspect, the drip tray may include a side wall defining a registration notch, wherein the retention arm of the drip pan bracket may be positioned in the registration notch to locate the drip pan bracket relative to the drain opening.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

An exemplary drying rack system 20 according to the principles of the present disclosure is shown and understood with reference to FIGS. 1-10. The drying rack system 20 of the present disclosure can provide multiple, vertically-arranged and horizontally-oriented load-bearing supports for supporting dishware or other items during drying after cleaning. The drying rack system 20 of the present disclosure can be easily adapted or modified to accommodate various and changing user requirements, and can readily accommodate operable integration with standard-sized industrial and/or commercial equipment with which the drying rack system may be associated during use.

Figure 1:
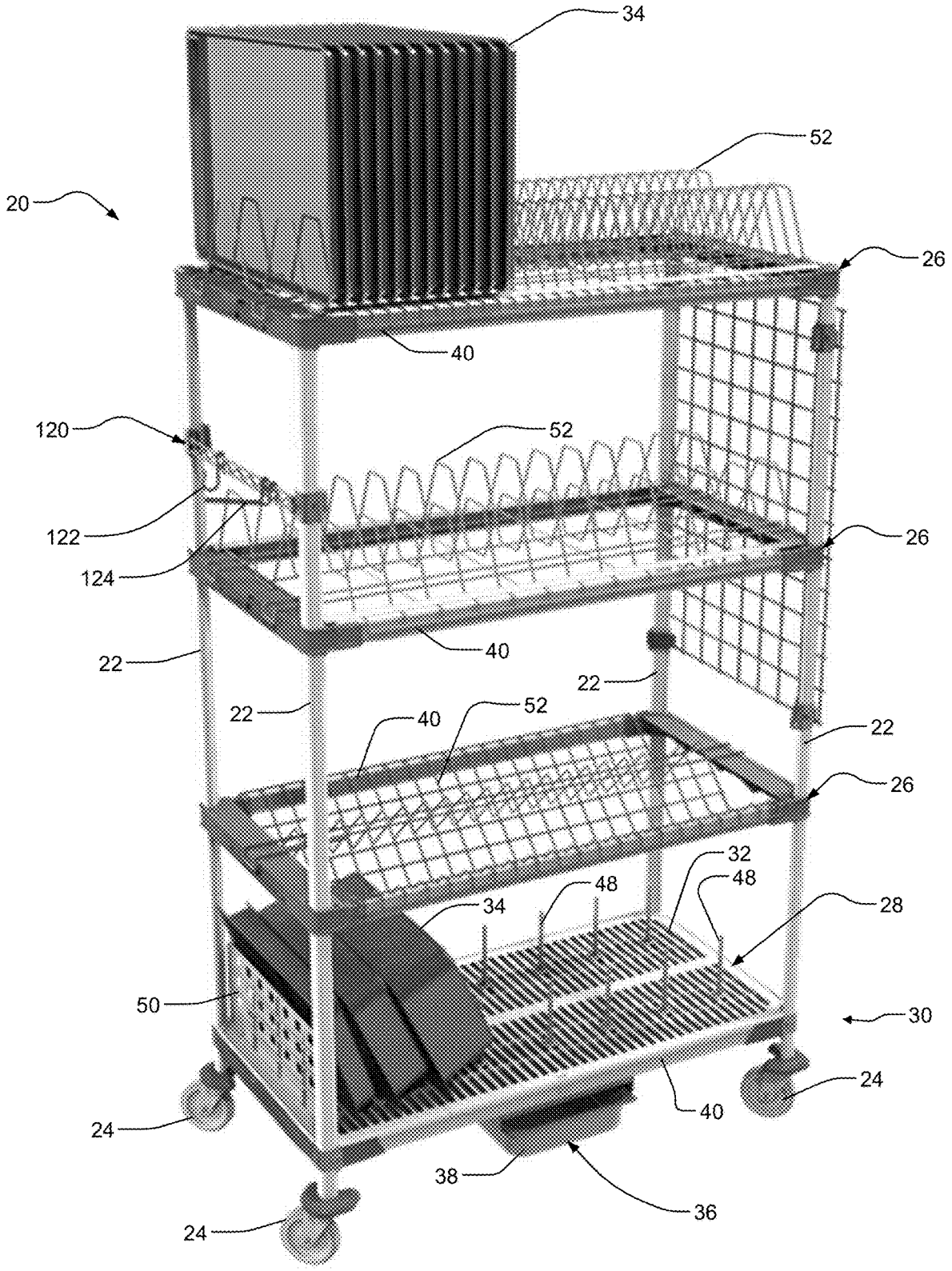
FIG. 1 is a perspective view of an exemplary drying rack system according to the principles of the present disclosure.

With reference to the FIG. 1, the drying rack system 20, in one example, can generally include a plurality of vertically-oriented post members 22 that can support one or more horizontal drying rack units 26, 28 at various vertical positions along the post members 22. The drying rack units 26, 28 can have various configurations as shown. In some configurations, the drying rack unit 26 can have an open configuration in which a frame 40 supports a wire separator 52 on which various pieces of dishware can be stored for drying. In other configurations, such as the lowermost drying rack unit 28, the drying rack unit 28 can have a covered configuration that may include a horizontal support surface as will be further described. In these configurations or others that may be used with the drying rack system 20, each of the drying rack units 26, 28 can support various items of dishware 34 in an elevated position to permit water to drain or evaporate from the dishware 34 after cleaning. The drying rack system 20 can also include one or more casters 24 positioned on the one or more of the post members 22. In this manner, the drying rack system 20 can be mobile (e.g., easily moved from one to location to another) in a working environment.

The drying rack system 20 can also include a water collector 36. The water collector 36 can receive water that drains from the dishware 34 instead of permitting such water to fall onto the floor. In the example shown, the water collector 36 is positioned below the lowermost drying rack unit 28 to form a drying rack assembly 30. In the lowermost position, the water that drains from the dishware 34 falls toward the water collector 36. The water is then directed or guided into a receptacle such as a drip pan 38 that can be easily removed and emptied. The drying rack system 20 that includes the water collector 36 directs and collects the water that drains from the dishware 34 rather than permitting the water to fall on the floor or other surface on which the drying rack system 20 is supported.

As previously stated, the water collector 36 can be positioned below the lowermost drying rack unit 28. In this position, the water collector 36 can collect water that falls from any of the drying racks 26, 28 positioned above. In other examples, each of the drying rack units 26, 28 can include a separate water collector 36 that is positioned below each of the drying rack units 26, 28. In still other examples, the drying rack system 20 can include water collectors 36 dispersed among the various drying rack units 26, 28 as needed or desired. As can be appreciated, the sizing of the dishware 34 that is dried on the drying rack units 26, 28 may limit the amount or positioning of the water collectors 36 that can be included in the drying rack system 20.

Figure 2:
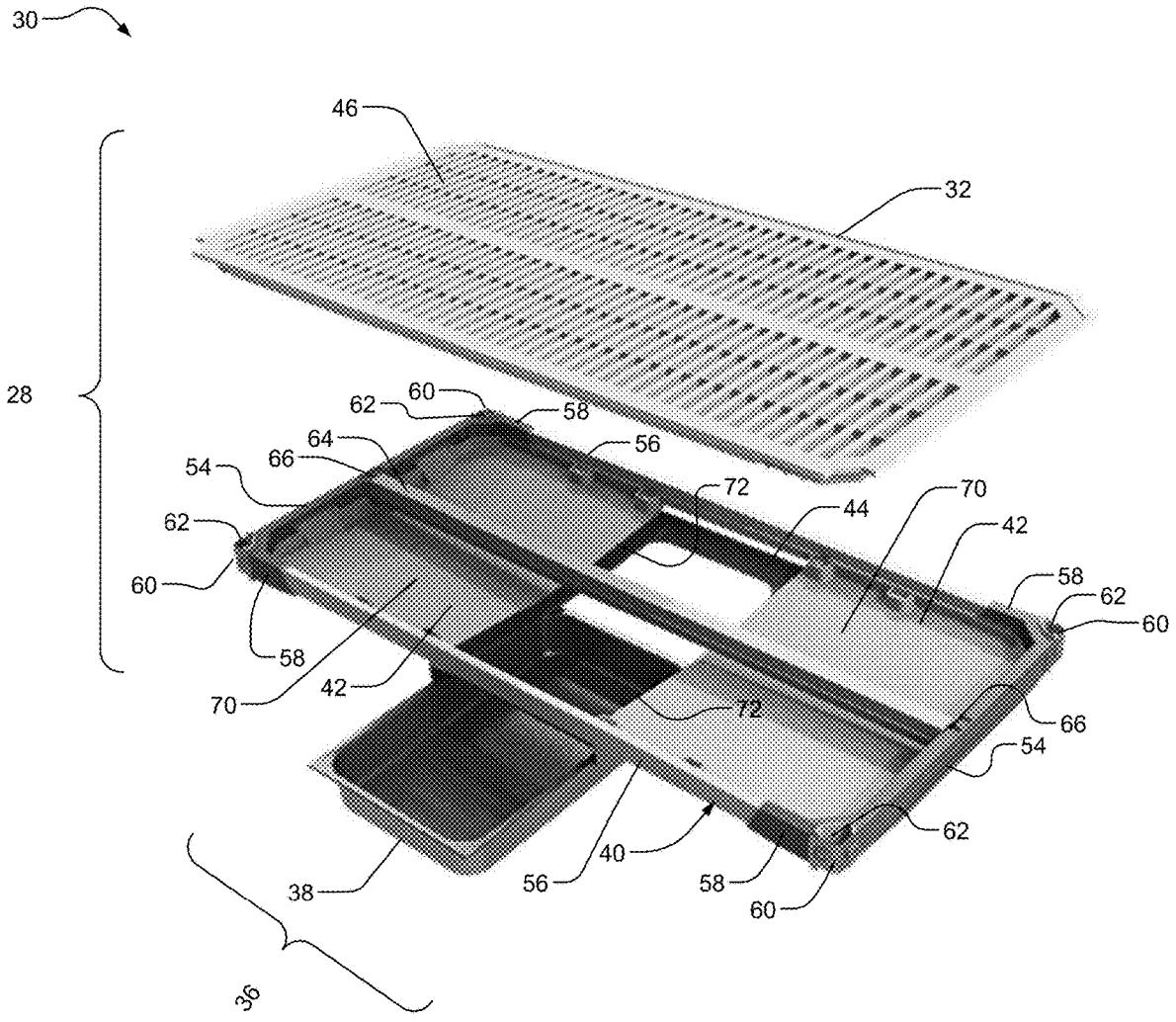
FIG. 2 is a semi-exploded view of an exemplary drying rack according to principles of the present disclosure.
Figure 3:
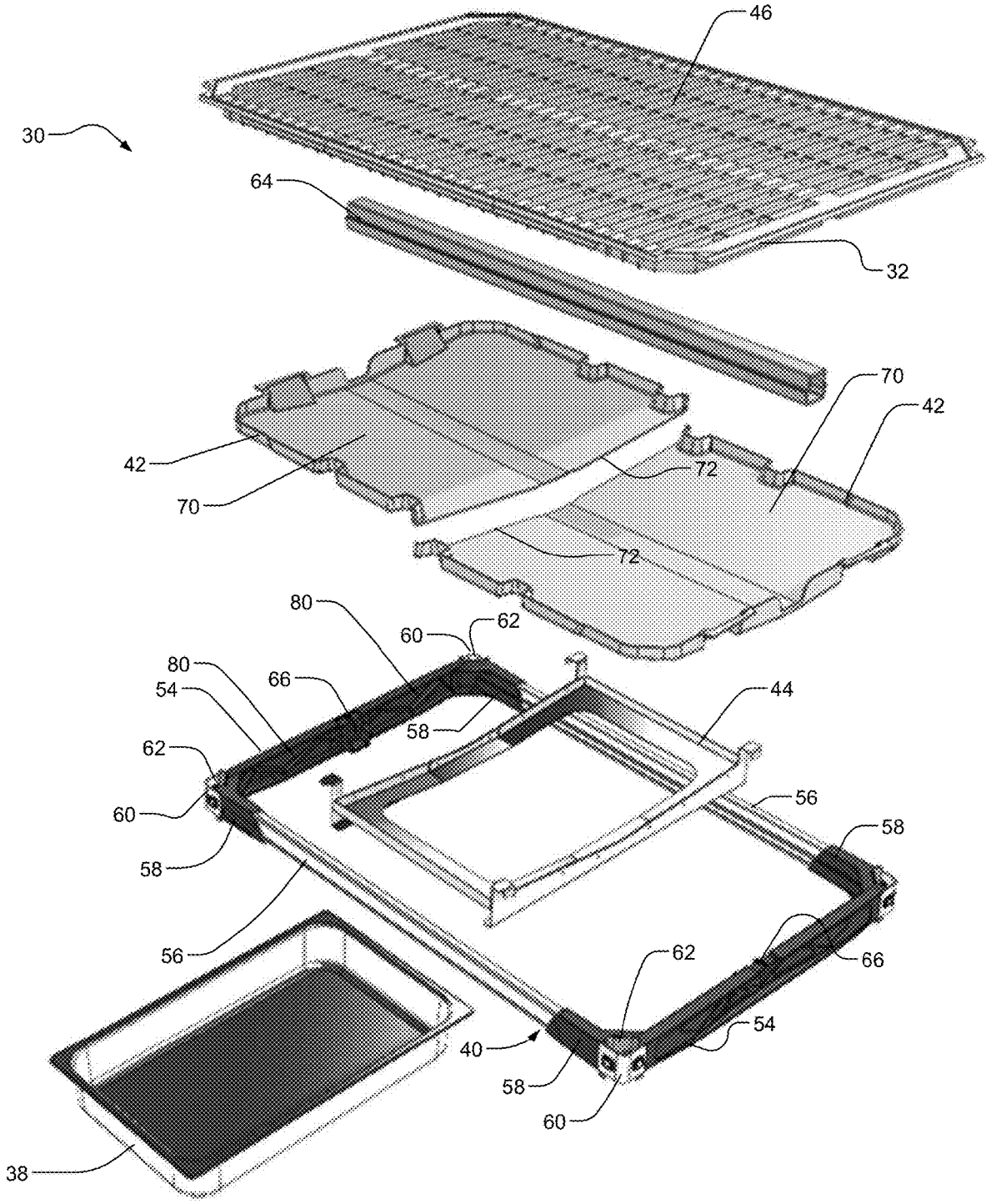
FIG. 3 is a full exploded view of the exemplary drying rack of FIG. 2.

Referring now to FIGS. 2 and 3, the drying rack assembly 30 can include the drying rack unit 28 and the water collector 36. The drying rack unit 28 can include a support shelf 32, a frame 40 and a drip tray 42. The water collector 36 can include a drip pan bracket 44 and the drip pan 38. The support shelf 32 can be a horizontal support surface that includes a plurality of perforations 46. The perforations 46 can be holes, slots or other openings through which water can move past or through the support shelf 32 and toward the drip pan 38. When dishware 34 is positioned on the support shelf 32 after cleaning, water can drip or flow from the dishware 34 toward the drip pan 38. The support shelf 32 can be molded or otherwise formed from a suitable material such as a plastic, metal or composite such that the support shelf 32 has a unitary structure. In other examples, the support shelf 32 can be constructed from one or more separate pieces and joined together.

Referring back to FIG. 1, the support shelf 32 can also include upright formations, inserts or other features that can be used to support the dishware 34 in an upright or vertical position to facilitate the flow of water from the dishware 34. In such upright positions, the water on the dishware 34 does not collect or puddle in the dishware 34. Furthermore, the dishware 34 is separated from adjacent pieces of dishware 34 to facilitate drying and to prevent the dishware 34 from moving or being dislodged from the drying rack unit 28. As shown in the lowermost drying rack unit 28 on FIG. 1, the support shelf 32 can include one or more pegs 48. The pegs 48 can be vertically-oriented posts that can fit inside the perforations 46. The support shelf 32 can also include a bulkhead 50 that can include extensions (not shown) that can fit inside the perforations 46. The bulkhead 50 can be a vertically-oriented support wall. The pegs 48 and/or the bulkheads 50 can be removed, adjusted and/or positioned on the support shelf 32 to retain, hold or separate the pieces of dishware 34 relative to the support shelf 32.

As further shown in FIG. 1, the support shelf 32 can have alternate configurations and can have the form of the separator 52. The separator 52 can be formed of a wire to have vertically-oriented support structures. The separator 52 can include a series of upright formations in which pieces of dishware 34 can be inserted to hold and/or separate the pieces of dishware 34 in an upright position for drying. As shown, the separators 52 are formed from a stainless steel or other suitable wire and can be positioned directly on the frames 40 of the drying racks 30. In other examples, the separators 52 can be positioned on top of the horizontal support surface support shelf 32 (FIG. 2) and can be made of other suitable materials and in other shapes and configurations.

Referring back to FIGS. 2 and 3, the support shelf 32 can be supported in a substantially horizontal position by the frame 40. The frame 40, in the example shown, has a shape that is complimentary or substantially similar to the outer shape or profile of the support shelf 32. In this manner, the support shelf 32 can be received in or on the frame 40. As shown, the frame 40 can have a rectangular profile. In other examples, the frame 40 can other profiles and shapes.

The frame 40 can include end portions 54 and side braces 56. The side braces 56 are connected to the end portions 54 to form the rectangular profile as previously described. The side braces 56 can be formed of a rectangular tubing or can have other cross-sectional shapes. The side braces 56 can be received into sockets 58 of the end portions 54 to form the frame 40. In this configuration, the side braces 56 can be easily inserted and removed from the end portions 54 for cleaning, assembly and/or disassembly.

The end portions 54, in the example shown, are formed of a suitable plastic or other suitable material and have a unitary structure. In other examples, the end portions can be made of one or more pieces joined together and/or can be made of other suitable metals, alloys or composites. Example suitable materials for food service environments can include stainless, steel, anti-microbial plastics and other materials approved by NSF International (formerly known as the National Sanitation Foundation). In addition to the sockets 58 previously described, the end portions 54 can include corners 60 that define post openings 62. The post openings 62 can have a size that is complimentary to the size of the post members 22. As such, the post members 22 can be received through the post openings 62 so that the frame 40 can be positioned and secured at a desired vertical location on the drying rack system 20. In the example shown, each end portion 54 includes two corners 60 that define two post openings 62.

When assembled, the frame 40 can have a rectangular shape formed by the two end portions 54 and the two side braces 56. The frame 40 provides structure and shape to the drying rack assembly 30 and one or more of the frames 40 can be used in connection with the post members 22 to form the drying rack system 20 previously described. As can be appreciated, the frame 40 can have various shapes, lengths and widths so that the drying rack system 20 and/or the drying rack assembly 30 can be used with standardized industrial, commercial or residential equipment and appliances.

As further shown in FIGS. 2 and 3, the frame 40 can also include a center beam 64. The center beam 64 can have any suitable cross-sectional profile and in the example shown, is formed of a rectangular tubing. In other examples, other suitable cross-sectional profiles can be used. The center beam 64 can be received in a center receptacle 66 positioned at or near the center of the end portions 54. The receptacles 66 can include a groove, offset or other formation such that the center beam 64 is retained in a desired position in the frame 40. The center beam 64 can be used to add rigidity to the frame 40 and prevent undesirable flexing or bending of the frame 40 when the drying rack assembly 30 is loaded with dishware 34.

The center beam 64 can be positioned in the same, or substantially the same, horizontal plane as the side braces 56 and/or the end portions 54. In such a position and as shown in FIGS. 2 and 3, the support shelf 32 can contact the end portions 54, the side braces 56 and the center beam 64 to prevent the sagging, bending or other movement of the support shelf 32 when the support shelf 32 is loaded with dishware 34.

The frame 40 also supports one or more drip trays 42 in a position vertically below the support shelf 32. The drip trays 42 are positioned below the support shelf 32 to guide or direct water that drips from or flows off of the dishware 34 toward the drip pan 38. The drip trays 42 can include a guide surface 70 that is angled downward from the sides of the drip trays 42 to guide or direct water that falls on the guide surface 70 toward a drip edge 72. The guide surfaces 70 can be angled toward a center of the drip tray in addition to being angled downward from a side of the drip tray 42 that engages the end portions 54 of the frame to guide water toward the drip edge 72.

Figure 4B:
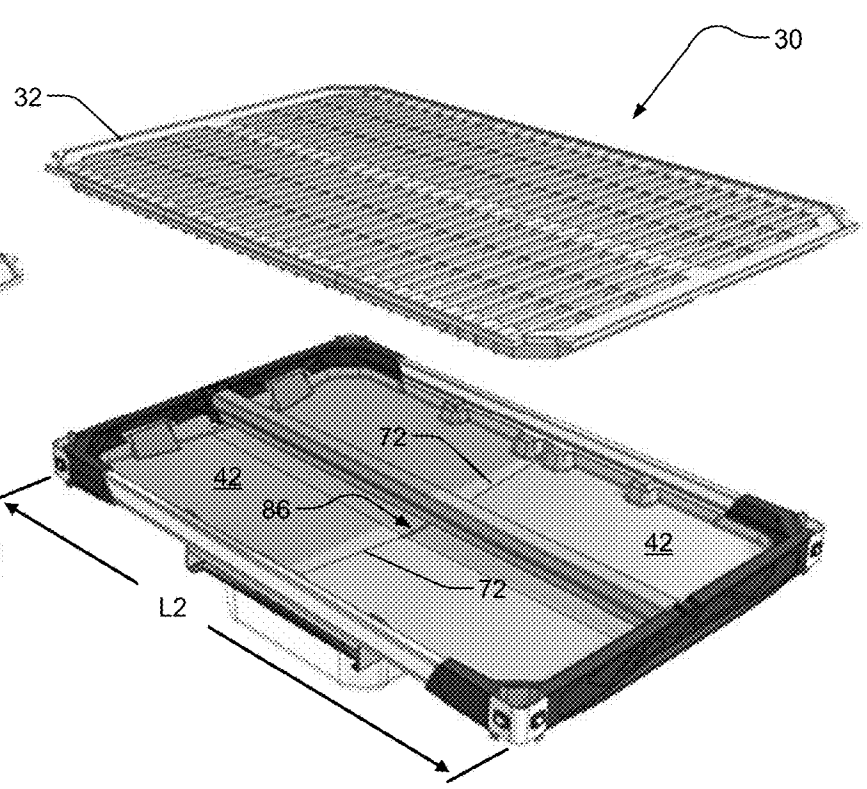
FIG. 4B is a semi-exploded view of the exemplary drying rack in a second configuration in which the drip trays are adjacent one another in the frame.
Figure 4A:
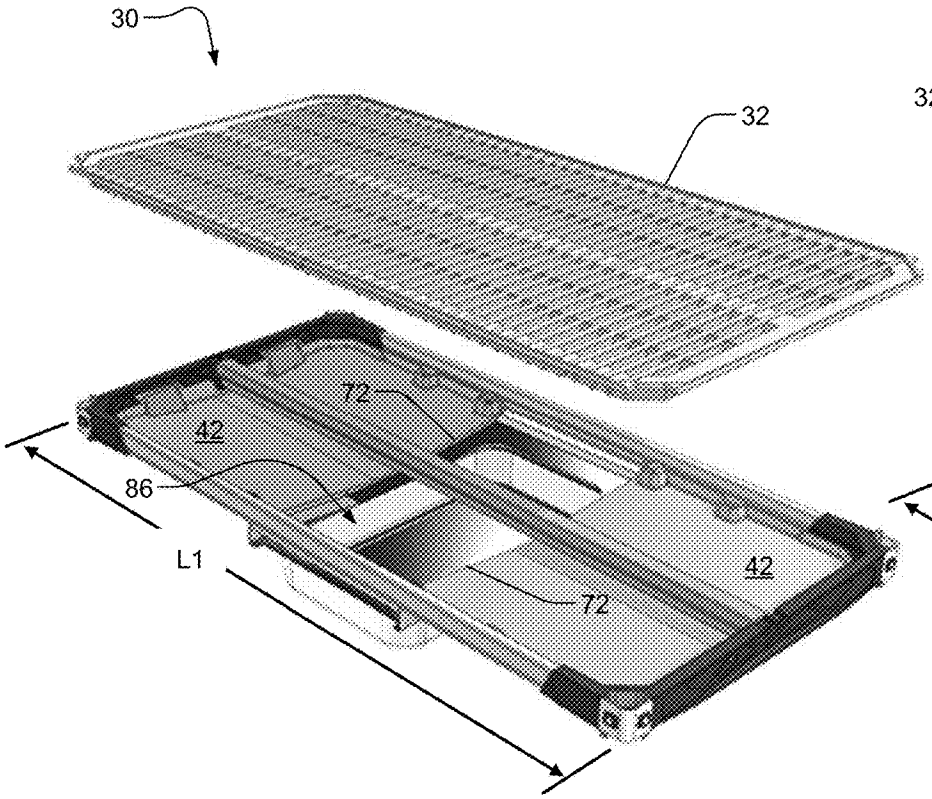
FIG. 4A is a semi-exploded view of the exemplary drying rack in a first configuration in which the drip trays are spaced apart from one another in the frame.

The drip trays 42 can have symmetrical configurations such that two identical drip trays 42 can be used and positioned opposite one another in the frame 40. While not shown, the drip trays 42 can also have asymmetrical configurations. The drip trays 42 can also be sized such that the drip trays 42 can accommodate frames 40 of varying lengths. For example and as shown in FIGS. 4A and 4B, the drip trays 42 can be sized such that the drip trays 42 are spaced apart from one another in a first configuration or substantially fill the frame 40 in a second configuration. In the first configuration shown in FIG. 4A, the two drip trays 42 are spaced apart from one another such that there is a gap between the opposite drip edges 72. In the second configuration as shown in FIG. 4B, the drip trays 42 can be positioned in the frame 40 such that the opposite drip edges 72 are positioned adjacent to one another and/or can abut one another. In such a manner, the drip trays 42 can accommodate frames 40 of different lengths. The frame 40 in the configuration depicted in FIG. 4A has a length L1 and the frame 40 in the configuration depicted in FIG. 4B has a length L2. As can be appreciated, the length L1 is greater than the length L2. In both the first configuration and in the second configuration, the guide surfaces 70 of the drip trays 42 guide water toward the drip edges 72 and into the drip pan 38.

The first and second configurations depicted in FIGS. 4A and 4B can correspond to standardized sizes of the frame 40. For example, standardized sizes of the frame 40 can include lengths of 48 inches in the first configuration and 36 inches in the second configuration. In the first configuration, the length L1 is 48 inches. The drip trays 42, when positioned in the frame 40 in the first configuration, are located such that the opposite drip edges 72 are spaced from one another by 12 inches. In the second configuration in which the length L2 is 36 inches, the same drip trays 42 would be positioned in the frame 40 with the opposite drip edges 72 spaced closely to one another and/or abutting one another. In such configurations and as further discussed below, the drip trays 42 can include or define a drain opening 86 or other gap to permit water to be directed or guided from the drip tray 42. As can be appreciated, the first and second configurations can correspond to other lengths of the frame 40 in addition to lengths described above. Such alternate lengths can correspond to other standardized sizes or to sizes predetermined for specific applications or for particular commercial, industrial or residential environments.

Figure 5:
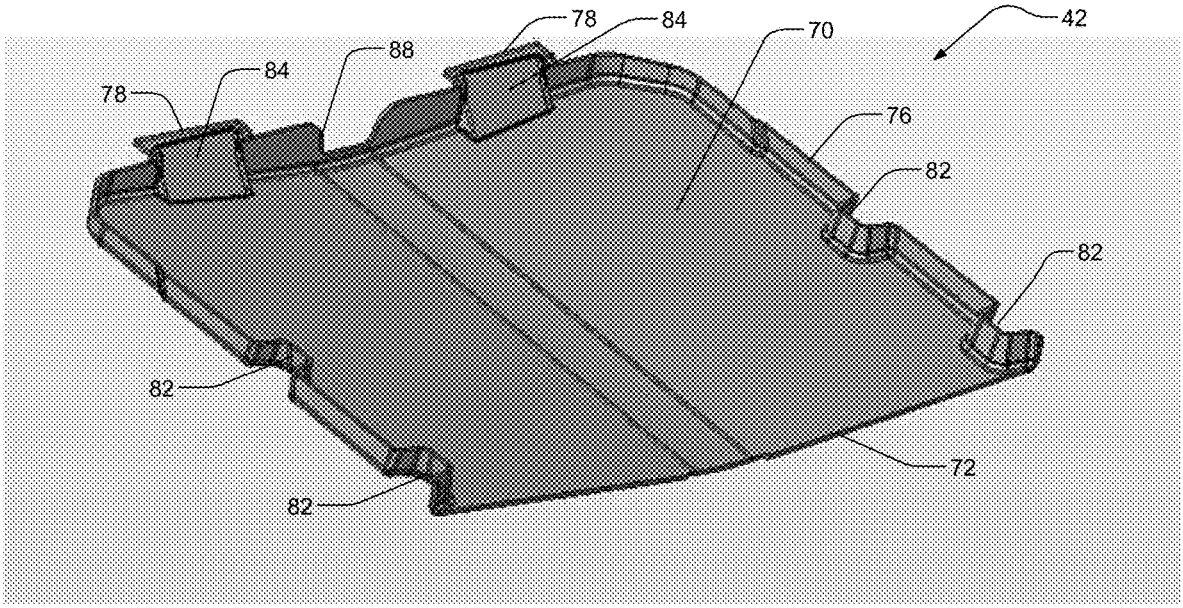
FIG. 5 is a perspective view of a drip tray of the exemplary drying rack of FIG. 2.
Figure 6:
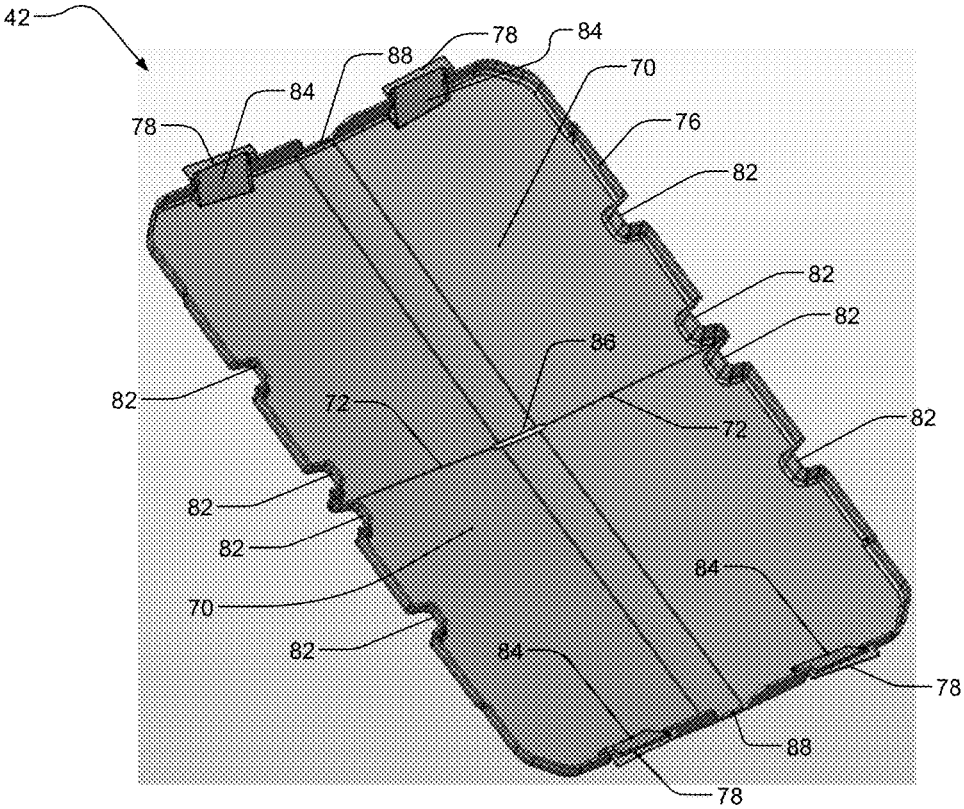
FIG. 6 is a perspective view of two drip trays positioned adjacent one another showing a drain opening defined therebetween.

As shown in FIGS. 5 and 6, the drip trays 42 can include a side wall 76 and one or more end tabs 78. The side wall 76 is a wall that can be positioned around a periphery of the drip tray 42. The side wall 76 can be vertically-oriented or otherwise positioned to prevent water that falls on the guide surface 70 from dripping off the sides of the drip tray 42 other than from the drip edge 72 or through a drain opening in the drip tray 42. The side wall 76 can have a profile that follows the inner profile of the frame 40. The side wall 76 can also define a center notch 88 and one or more registration notches 82. The center notch 88 can be positioned at a center of the drip tray 42 and can have a shape that corresponds to the outer shape of the center beam 64. As such, the center notch 88 is positioned and shaped to prevent interference between the drip tray 42 and the center beam 64. In the example shown, the center notch 88 has a rectangular shape to correspond to the center beam 64. In other examples, the center notch 88 can have other shapes.

The registration notches 82 are positioned on side portions of the side wall 76. The registration notches 82 can be rectangular formations in the side wall 76 that project inwardly toward the center of the drip tray 42. The registration notches 82 are formations that prevent the interference between the drip pan bracket 44 (see FIGS. 2 and 3) and the drip tray 42. As will be further described below, the drip pan bracket 44 can include on or more retention arms that engage the frame 40 at a vertical location that coincides with the positioning of the drip tray 42. The registration notches 82 permit the drip pan bracket 44 to engage the frame 40. In addition to providing such relief, the registration notches 82 are positioned relative to the side braces 56 of the frame 40 to locate the drip pan bracket 44 in a desired position relative to the drip trays 42. When the drip pan bracket 44 is positioned in the desired position relative to the drip trays 42, the drip pan bracket 44 positions the drip pan 38 (FIG. 2) in a position under the drip edges 72 such that water is directed or guided into the drip pan 38. In the example shown, the side wall 76 includes two pairs of registration notches 82 in each drip tray 42. The first pair of registration notches 82 can be located adjacent to the drip edge 72 to locate the drip pan bracket 44 in the desired position when the drip trays 42 are used in the first configuration (see FIG. 4A). The second pair of registration notches 82 located away from the drip edge 72 locates the drip pan bracket 44 in the desired position when the drip trays 42 are used in the second configuration (see FIG. 4B). In other examples, the drip trays 42 can include more registration notches 82 and/or can include registration notches 82 positioned at other locations to position the drip pan bracket 44 at other desired relative locations.

The end tabs 78 can be positioned on a side of the drip tray 42 that is oriented adjacent the end portion 54 of the frame 40. The end tabs 78 are features of the drip tray 42 that support and/or retain the drip tray 42 relative to the frame 40. The end tabs 78, in the example shown, project outward from the side wall 76 of the drip tray 42. The end tabs 78 can have a rectangular or other suitable shape. The end tabs 78 can engage or be supported by a complimentary tab support 80 (FIG. 3) on the end portion 54. The tab support 80 (FIG. 3) can be a rib that projects outward from the end portion 54. When the drip tray 42 is assembled into the frame 40, the end tabs 78 can be positioned against the tab support 80 in the end portion 54. Such engagement can vertically support the drip tray 42. The tab supports 80 can have a V-shaped profile or other shape to prevent undesirable movement of the drip tray 42.

The drip tray 42 can also include a stanchion 84 positioned inward of each end tab 78. The stanchion 84 is a formation in the side wall 76 and/or in the guide surface 70 that provides rigidity to the drip tray 42 at or near the end tab 78. The stanchion 84 alleviates stress concentrations that may otherwise occur at the corners of the end tab 78 and/or at the transition between the side wall 76 and the guide surface 70. In the example shown, the stanchion 84 is an angled surface that is angled from the top of the end tab 78 toward the guide surface 70. In other examples, the stanchion 84 can have other shapes or formations and may include one or more darts, ribs or other features to further strengthen or stiffen the drip tray 42.

As previously described, a pair of drip trays 42 can be used in the drying rack assembly 30. In the configuration depicted in FIG. 4B, two separate drip trays 42 are positioned opposite one another in the frame 40. In such a position, the drip edges 72 can be positioned adjacent or abutting one another as shown in FIG. 6. In this configuration, the drip trays 42 can include a formation in the drip edges 72 to define a drain opening 86. As shown, each of the drip edges 72 includes a notched portion that is notched inwardly toward the end tabs 78. With such a formation, the oppositely positioned drip edges 72 can define the drain opening 86. Since the guide surfaces 70 are angled toward the center of the drip tray 42 and toward the drip edges 72, water can flow or otherwise move along the guide surfaces 70 and through the drain opening 86.

In the configuration in which the drip edges 72 are spaced apart from one another (FIG. 4A), the drain opening 86 is defined by the spaced apart drip edges 72. The angular orientation of the guide surfaces 70 will cause the water to flow or otherwise move along the guide surfaces 70 and through the drain opening 86.

Instead of a pair of drip trays 42, the drying rack assembly 30 can include a single unitary drip tray 42. In such an example, the drip tray 42 can have the same or a similar appearance to the pair of drip trays 42 depicted in FIGS. 4A and 4B. In such an example, the unitary drip tray 42 can have a drain opening 86 positioned at a center of the drip tray 42 and the guide surface 70 can funnel water toward and through the drain opening 86 as previously described. In other examples, the drain opening 86 can be positioned offset from a center of the drip tray 42 or skewed to one side of the drip tray 42. The unitary drip tray 42 can be molded or otherwise formed as a single unit out of a suitable plastic, metal, or composite material.

As will be described below, the drip trays 42 are configured to direct or guide water through the drain opening 86 that is defined by the drip edges 72 and into the drip pan 38. In other examples (not shown), the drip tray 42, in either a multiple-piece or unitary construction, can include a drain opening that is positioned at any suitable position on the guide surface 70. Such a drain opening can be positioned offset from the center of the drip tray 42. The drain opening can also include a connection for attaching a length of pipe or tubing and/or include a valve to selectively permit water to be directed or guided from the drip tray 42 to a receptacle or directly to a floor drain or other disposal. In still other examples, the drip tray 42 can include two or more drain openings as may be desired for directing or guiding water to multiple locations, for example.

Figure 7:
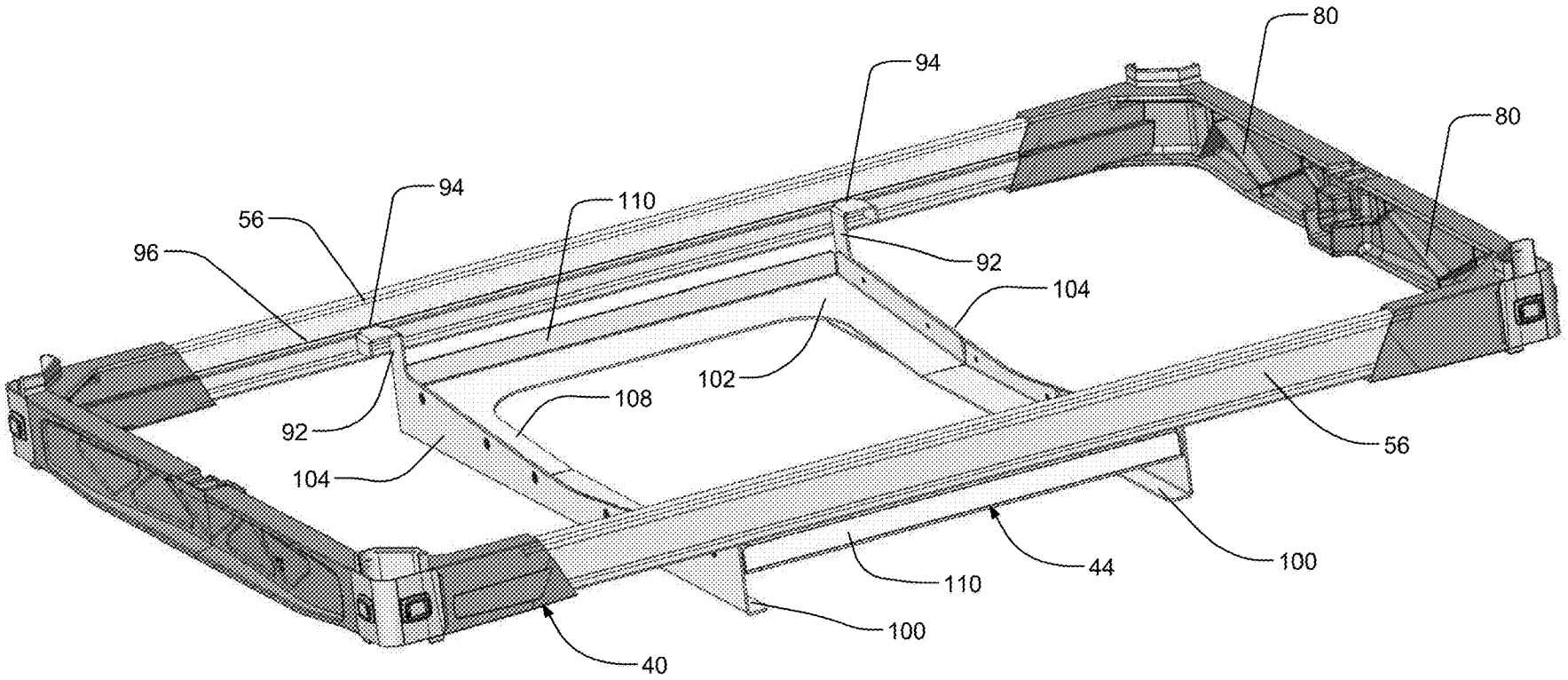
FIG. 7 is a perspective view of a drip pan bracket supported in the frame of the exemplary drying rack of FIG. 2.
Figure 8:
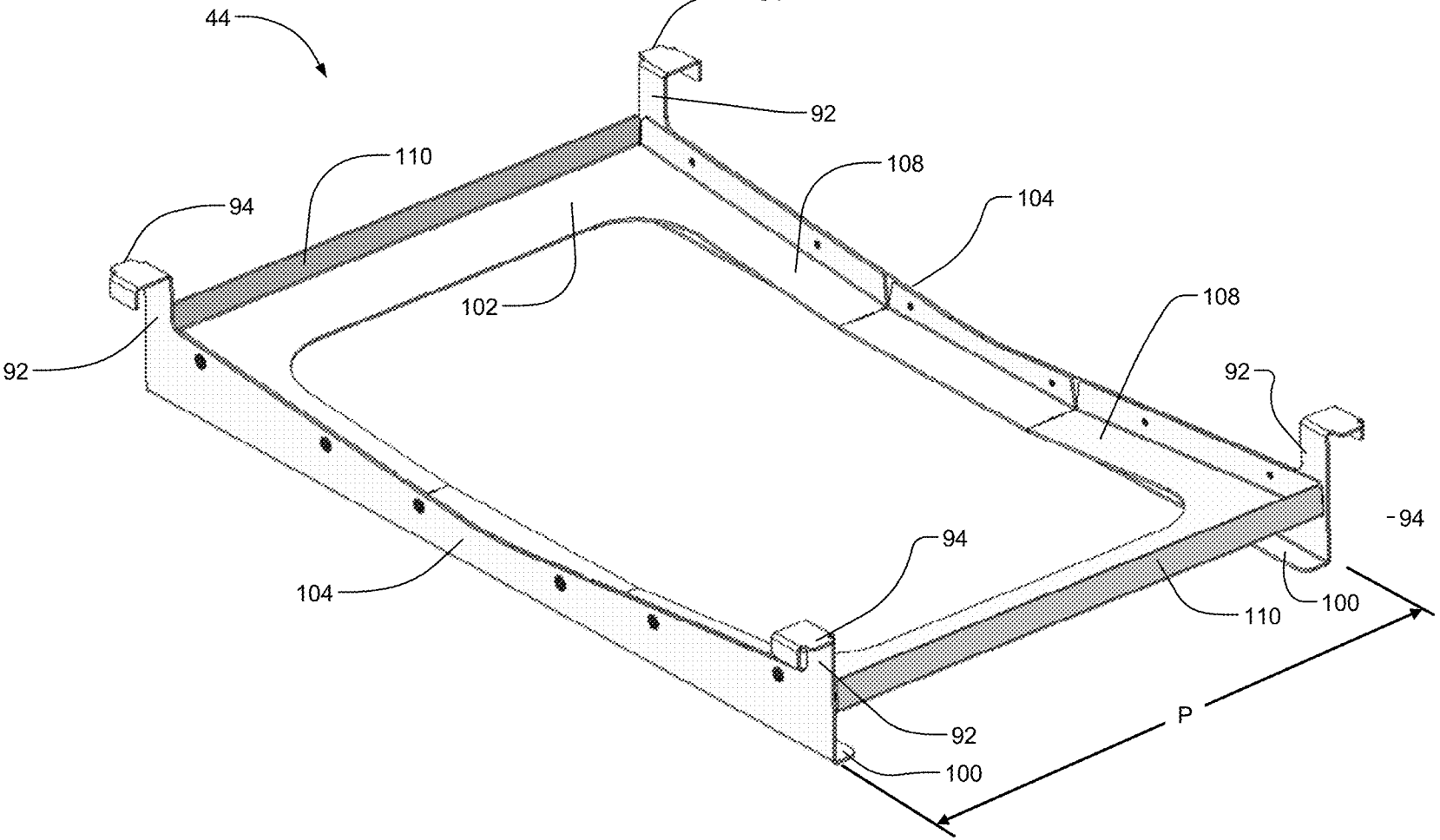
FIG. 8 is perspective view of the drip pan bracket shown in FIG. 7.

Referring now to FIGS. 7 and 8, the drip pan bracket 44 of the drying rack assembly 30 is supported in the frame 40 by one or more retention arms 92. In this example, the drip pan bracket 44 includes four retention arms 92 projecting upward from each corner of the drip pan bracket 44. Each retention arm 92 vertically supports the drip pan bracket 44 in a position below the drip trays 42. As described, the drip pan bracket 44 retains the drip pan 38 under the drip edges 72 and under the drain opening 86 to collect the water that drips from the dishware 34.

In the example shown, each retention arm 92 can have an upside-down J-shape and can include a rail engagement tab 94. The rail engagement tab 94, in this example, projects outward from the retention arm 92 toward the side braces 56 of the frame 40. The side braces 56 of the frame 40, in turn, can include a rail ledge 96 that projects inwardly toward the drip pan bracket 44. The rail ledge 96 can extend along the inner side of each side brace 56 so that the drip pan bracket 44 can be positioned at any location along the side braces 56 in the frame 40. In other examples, the drip pan bracket 44 can include other features or configurations of the retention arms 92 to retain the drip pan bracket 44 in position. For example, the retention arms 92 can include tabs, pegs or extensions that can engage corresponding openings or formations in the side braces 56. In still other examples, the drip pan bracket 44 can include an L-shaped flange to engage the rail ledge 96 or the drip pan bracket 44 and/or the side brace 56 can include complimentary hooks or flanges that can engage with one another to retain the drip pan bracket 44 in position relative to the frame 40.

The drip pan bracket 44, in the example shown, also includes two opposing pan rails 100. The pan rails 100 are positioned opposite to one another and include opposing horizontal surfaces that are spaced apart from one another by a distance P (FIG. 8). The distance P corresponds to a distance that is greater than a distance of opposing flanges of the drip pan 38. In this configuration, the drip pan 38 can be inserted between the pan rails 100 and is vertically supported by the pan rails 100. As such, the drip pan 38 can be easily inserted into the drip pan bracket 44 and removed from the drip pan bracket 44 in order to dispense with any water that has been collected in the drip pan 38.

The drip pan 38 can be any suitable pan, tray, or other collection device. If the drying rack assembly 30 is used in the context of a commercial or industrial kitchen environment, the drip pan bracket 44 can be configured to receive a drip pan 38 that is a standardized gastronorm or standardized food service pan. In one example, the drip pan bracket 44 is sized to receive a standard full-size food service pan that measures 20 inches by 12 inches. In such an example, the dimension P of the drip pan bracket 44 can be slightly greater than 12 inches to accept the pan therein. In other examples, the drip pan bracket 44 can be sized to accept drip pans 38 of other sizes and of other shapes.

Referring back to FIGS. 7 and 8, the drip pan bracket 44 can also include a body 102 and two cross-braces 104. The two cross-braces 104 can each include the retention arms 92 and the pan rail 100 with the body 102 positioned therebetween. The body 102 can be connected to the cross-braces 104 using suitable attachments such as rivets, screws or the like or can be connected by welds, adhesive, staking or other suitable connection method. As shown, the drip pan bracket 44 can be formed of stainless steel or other alloy or composite. In other examples, the drip pan bracket 44 can be molded or otherwise formed from a suitable plastic or other material as a unitary structure.

As further shown, the body 102 of the drip pan bracket 44 can include a drain surface 108 that can be angled toward a center of the drip pan bracket 44 to cause water than may drip on the drip pan bracket 44 to move toward the center of the drip pan bracket 44 and into the drip pan 38. The drip pan bracket 44 can also include one or more flanges 110 that can be used to stiffen the drip pan bracket 44.

With reference back to FIGS. 2 and 3, the drying rack assembly 30 can be assembled as follows. The drip pan bracket 44 is installed into the frame 40. In the installed position, the rail engagement tabs 94 of the drip pan bracket 44 are positioned on the rail ledges 96 of the side braces 56. The drip trays 42 can then be installed over the drip pan bracket 44. When the drip trays 42 are installed, the drip pan bracket 44 can be moved along the rail ledges 96 so that the retention arms 92 are positioned inside the registration notches 82 of the drip trays 42. When the retention arms 92 of the drip pan bracket 44 are positioned in the registration notches 82, the drip pan bracket 44 is appropriately positioned relative to the drip trays 42 so that water that drips or flows from the drip trays 42 will enter and be collected by the drip pan 38. Once the drip trays 42 and the drip pan bracket 44 are correctly installed, the center beam 64 can be installed into the center receptacles 66 of the frame 40 and the support shelf 32 (and/or the separator 52) can be installed on the frame 40 over the drip trays 42. The drip pan 38 can then be installed into the drip pan bracket 44 by sliding the drip pan 38 onto the pan rails 100.

Once assembled, the drying rack assembly 30 can be used to dry dishware 34. After cleaning, the wet dishware 34 can be placed on the support shelf 32. Water from the dishware 34 can drip or flow through the perforations 46 of the support shelf 32 and collect on the guide surfaces 70 of the drip trays 42. Since the guide surfaces 70 are angled toward the center of the drying rack unit 28, the water flows along the guide surfaces 70 and through the drain opening 86. The water then can fall through the drip pan bracket 44 and into the drip pan 38. In this manner, the drying rack assembly 30 can collect water that drips or drains from the dishware 34. An operator can then periodically remove the drip pan 38 from the drip pan bracket 44 to empty the drip pan 38 into a sink or other suitable drain.

The drying rack assembly 30 can also be assembled into the drying rack system 20. In such a system, the drying rack assembly 30 can direct and collect water from any dishware 34 than may be positioned above the drying rack assembly 30.

In other examples of the drying rack unit and/or the drying rack assembly (not shown), the drip pan 38 or the drip trays 42 can include a drain tube and/or valve that permits the water that is collected in the drip pan 38 or the drip trays 42 to flow into a sink, floor drain or other suitable drain location. In such examples, a drain tube can be fluidly connected to the drip pan 38 or the drip trays 42 to allow the water to flow into the drain tube. The drain tube can be routed from the drip pan 38 or the drip trays 42 to the sink or other drain. In such examples where the sink or other drain is located in a remote location from the drying rack unit 28, the drain tube can be connected to a valve and/or a pump to move the water from the drip pan 38 or the drip trays 42 through the drain tube to the sink or other drain.

The drying rack assembly 30 and the drying rack system 20 of the present disclosure are improvements over existing drying racks because of the ability to direct and collect the water from the dishware 34 rather than permitting the water that falls from the dishware to fall on the ground, floor or other surface on which the drying rack may be positioned.

In addition, the drying rack assembly 30 and the drying rack system 20 can be easily assembled and disassembled. Not only can the drip pan 38 be easily removed to empty the water that is collected by the drying rack assembly 30 but the various components of the drying rack assembly 30 (e.g., the frame 40, the drip trays 42, the center beam 64, the drip pan 38 and the drip pan bracket 44) can also be easily disassembled and reassembled for cleaning, storage and use. The components of the drying rack assembly 30 can be sized so as to be modular in nature such that they can be used on other standardized storage systems or in connection with other standardized commercial, industrial or residential appliances and equipment.

Figure 9:
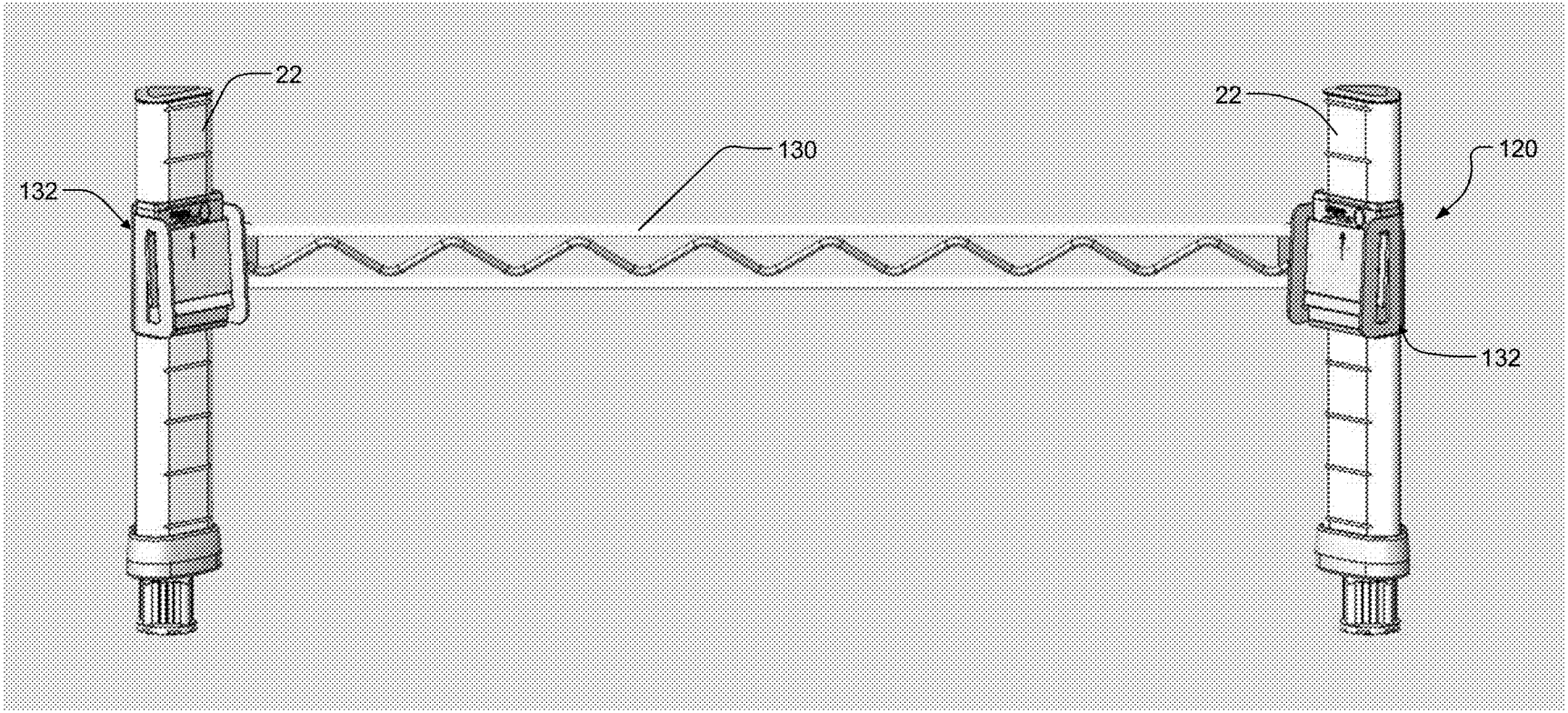
FIG. 9 is a perspective view of an exemplary accessory storage bar according to principles of the present disclosure.
Figure 10:
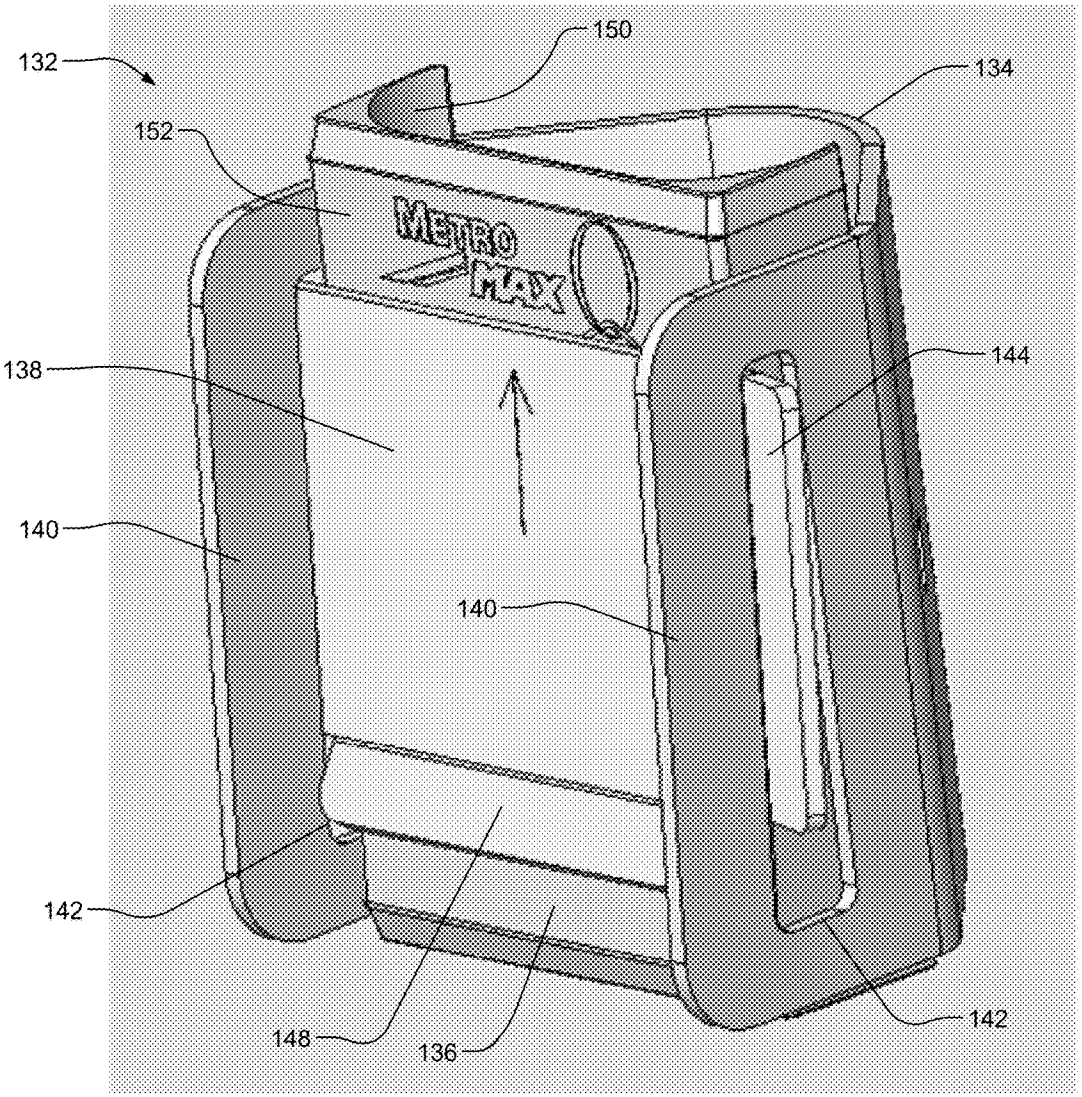
FIG. 10 is a perspective view of an attachment collar of the exemplary accessory storage bar of FIG. 9.

With reference to FIGS. 1, 9 and 10, the drying rack system 20 can also include an accessory storage bar 120. As shown in FIG. 1, the accessory storage bar 120 can be secured to the post members 22 in a position that spans between two adjacent post members 22. In this position, the accessory storage bar 120 can be used to support a hook 122, a rod 124 or other retention or support structure. The accessory storage bar 120 can be used to retain various accessory items for drying or storing. For example, the hook 122 and/or the rod 124 can be used to support various kitchen utensils, towels, appliances, dishware, cookware, aprons, and the like.

As shown in FIG. 9, the accessory storage bar 120 can be supported by two post members 22. In the example shown, the post members 22 have a triangular cross-sectional shape. The accessory storage bar 120 can be configured to be used with post members 22 having other cross-sectional shapes including round, square or rectangular shapes as well. As shown, the accessory storage bar 120 can include a beam member 130 and one or more attachment collars 132. Each of the attachment collars 132 can include a strap member 134, a wedge 136 and a retention plate 138.

The beam member 130 is an elongated support member that spans between the two attachment collars 132. The beam member 130 can have any suitable shape or construction. In the example shown, the beam member 130 is made of stainless steel wire. The beam member 130 can be secured between the two attachment collars 132 using any suitable connection such as fasteners, welding, staking or the like. As can be appreciated, the beam member 130 is constructed to support the hook 122, the rod 124 or other retention members. As such the beam member 130 can have openings or a suitable profile to accept and support such retention members.

Each of the attachment collars 132 is configured to be removably secured to a post member 22. The attachment collars 132 can be easily secured in a desired position and removed and/or adjusted. As shown in FIG. 10, the strap member 134 can have a suitable cross-sectional shape such that the strap member 134 can wrap around a portion of the post member 22. At opposing ends 140, the strap member 134 can include a slot 142. The slots 142 can have a shape that tapers in width such that a bottom width of the slot is greater than a top width of the slot.

The retention plate 138 can be received in the slots 142 and extend across the opposing ends 140 of the strap member 134. The wedge 136 is positioned between the retention plate 138 and the post member 22. The retention plate 138 can have any suitable shape and in the example shown has a generally rectangular outer profile. The retention plate 138 can include end tabs 144 that can extend outwardly from the slots 142 and a base tab 148 that extends from a base of the retention plate 138 between the opposing ends 140 of the strap member 134.

The wedge 136 can also have any suitable shape and in the example shown has an inner surface 150 that is cooperatively shaped to, at least, partially surround the post member 22. The wedge 136 can also have an outer surface 152 that is substantially planar and cooperatively shaped to engage the portion of the retention plate 138 that is positioned between the opposing ends 140 of the strap member 134.

With this configuration, the attachment collar 132 can operate to secure the accessory storage bar to the post member 22. With the wedge 136 positioned between the retention plate 138 and the post member 22, the retention plate 138 can move toward the post member 22 in the slots 142 as a downwardly directed force is exerted on the attachment collar 132. As the retention plate 138 moves toward the post member 22, the wedge 136 is compressed against the post member 22 to secure the attachment collar 132 in a desired position. As can be appreciated, the attachment collar 132 can be easily removed from or adjusted relative to the post member 22 by exerting an upwardly directed force on the attachment collar 132 that permits the retention plate 138 to move downwards in the slots 142 and away from the post member 22.

The retention plate 138 can be made of a suitable structural material such as stainless steel. In other examples, the retention plate 138 can be made of other suitable metal, alloy, plastic or composite materials. The wedge 136 is preferably made of an elastomeric material such as a suitable plastic material. In other examples, the wedge 136 can be made of other materials such as natural or synthetic rubber.

The drying rack assembly 30, the accessory storage bar 120 and/or the various elements thereof can be made of any suitable material as described above. In addition, the materials of such assemblies and components can include additives or coatings that inhibit or prevent the growth of bacteria or other contaminants that can stain, cause odors or otherwise foul such assemblies and components.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A drying rack for collecting water from one or more pieces of dishware, the drying rack comprising:

a frame;

a support shelf removably positioned on the frame, the support shelf configured for supporting the one or more pieces of dishware;

a drip tray removably supported by the frame below the support shelf, the drip tray including a guide surface and defining a drain opening, wherein the guide surface is angled toward the drain opening to guide water toward the drain opening; and a drip pan bracket supported by the frame, the drip pan bracket including a pair of pan rails configured to removably receive and position a drip pan below the drain opening to collect the water guided by the guide surface through the drain opening;

wherein the frame includes a rail ledge projecting inwardly from an inner surface thereof, the drip pan bracket including at least one retention arm with a rail engagement tab, the rail engagement tab engaging the rail ledge to support the drip pan bracket on the frame.

2. The drying rack of claim 1, wherein the drip tray includes a side wall defining a registration notch, the at least one retention arm being positioned in the registration notch to locate the drip pan bracket relative to the drain opening.

3. A drying rack for collecting water from one or more pieces of dishware, the drying rack comprising:

a frame;

a support shelf removably positioned on the frame, the support shelf configured for supporting the one or more pieces of dishware;

a drip tray removably supported by the frame below the support shelf, the drip tray including a guide surface and defining a drain opening, wherein the guide surface is angled toward the drain opening to guide water toward the drain opening; and a drip pan bracket supported by the frame, the drip pan bracket including a pair of pan rails configured to removably receive and position a drip pan below the drain opening to collect the water guided by the guide surface through the drain opening;

wherein the drip pan bracket includes a body and a pair of cross-braces, the body being connected between the pair of cross-braces and including a drain surface positioned vertically between the drip tray and the pair of pan rails, the drain surface angled toward a center of the drip pan bracket.

4. The drying rack of claim 3 wherein each cross-brace of the pair of cross-braces includes one pan rail of the pair of pan rails and a pair of retention arms.

5. The drying rack of claim 3 wherein:

the frame includes a rail ledge projecting inwardly from an inner surface thereof; and each cross-brace of the pair of cross-braces includes a pair of retention arms each including a rail engagement tab, wherein each rail engagement tab engages the rail ledge to support the drip pan bracket on the frame.

6. The drying rack of claim 3 wherein the drip tray includes a drip edge, the drip edge positioned above the drain opening.

7. The drying rack of claim 1 wherein the drip tray includes at least one end tab projecting outward from an outer periphery of the drip tray, the at least one end tab configured to engage the frame to support the drip tray above the drip pan bracket.

8. The drying rack of claim 1 wherein the drip tray includes a side wall projecting upwards from the guide surface that is disposed adjacent an inner surface of the frame.

9. The drying rack of claim 8 wherein the side wall defines at least one registration notch, the registration notch projecting inward from the inner surface of the frame and being configured to receive a retention arm on the drip pan bracket, the drip pan bracket being located in a predetermined location relative to the drip tray when the retention arm is positioned in the registration notch.

10. The drying rack of claim 9 wherein the frame includes a center column positioned along a center of the frame, the side wall including a center notch to prevent interference between the center column and the drip tray.

11. A drying rack for collecting water from one or more pieces of dishware, the drying rack comprising:

a frame;

a support shelf removably positioned on the frame, the support shelf configured for supporting the one or more pieces of dishware;

a drip tray removably supported by the frame below the support shelf, the drip tray including a guide surface and defining a drain opening, wherein the guide surface is angled toward the drain opening to guide water toward the drain opening; and a drip pan bracket supported by the frame, the drip pan bracket including a pair of pan rails configured to removably receive and position a drip pan below the drain opening to collect the water guided by the guide surface through the drain opening;

wherein the drip tray comprises a first drip tray including a first drip edge and a second drip tray comprising a second drip edge, the first drip edge and the second drip edge defining the drain opening.

12. The drying rack of claim 11 wherein the first drip edge and the second drip edge are positioned adjacent one another.

13. The drying rack of claim 11 wherein the first drip edge and the second drip edge are spaced apart from one another.

14. The drying rack of claim 11 wherein the first drip tray and the second drip tray are each separately removable from the frame.

15. A drying rack system comprising:

a plurality of vertically-oriented post members; and the drying rack of claim 11, wherein the frame is supported in a horizontal orientation by the plurality of vertically-oriented post members.

16. The drying rack of claim 15 wherein the support shelf comprises a plurality of vertically-oriented separators configured to support pieces of dishware in an upright position.

17. The drying rack of claim 15 wherein the support shelf comprises a horizontally-oriented surface that includes a plurality of perforations.

18. A drying rack comprising:

a frame comprising;

a first end portion;

a second end portion;

a first side brace connected between the first end portion and the second end portion, the first side brace including a first rail ledge projecting inward from an inner surface thereof; and a second side brace connected opposite to the first side brace between the first end portion and the second end portion, the second side brace including a second rail ledge projecting inward toward the first rail ledge from an inner surface of the second side brace;

a support shelf removably positioned in a substantially horizontal orientation in the frame, the support shelf including a plurality of perforations to allow a fluid to flow therethrough;

a first drip tray removably supported by the frame below the support shelf, the first drip tray including a first guide surface and a first drip edge;

a second drip tray supported by the frame below the support shelf and opposite the first drip tray, the second drip tray including a second guide surface and a second drip edge, wherein the first drip edge and the second drip edge define a drain opening therebetween, and the first guide surface and the second guide surface are each angled toward the drain opening to guide the fluid toward the drain opening; and a drip pan bracket comprising:

a first pair of rail engagement tabs projecting outward from a first pair of attachment arms, the first pair of rail engagement tabs engaging the first rail ledge to support the drip pan bracket;

a second pair of rail engagement tabs projecting outward from a second pair of attachment arms, the second pair of rail engagement tabs engaging the second rail ledge to support the drip pan bracket; and a pair of pan rails positioned below the first pair of rail engagement tabs and below the second pair of rail engagement tabs, the pair of pan rails spaced apart from one another in a parallel orientation to support a drip pan below the drain opening.

19. A drying rack system comprising:

a plurality of vertically-oriented post members; and the drying rack of claim 1, wherein the frame is supported in a horizontal orientation by the plurality of vertically-oriented post members.

20. The drying rack of claim 3, wherein the drip tray includes a side wall defining a registration notch;

wherein a retention arm is positioned in the registration notch to locate the drip pan bracket relative to the drain opening.

21. A drying rack system comprising:

a plurality of vertically-oriented post members; and the drying rack of claim 3, wherein the frame is supported in a horizontal orientation by the plurality of vertically-oriented post members.

22. The drying rack of claim 11 wherein at least one of the first drip tray and the second drip tray includes a side wall projecting upwards from the guide surface that is disposed adjacent an inner surface of the frame; and wherein the side wall defines at least one registration notch, the at least one registration notch projecting inward from the inner surface of the frame and being configured to receive a retention arm on the drip pan bracket;

wherein the drip pan bracket is located in a predetermined location relative to the at least one of the first drip tray and the second drip tray when the retention arm is positioned in the at least one registration notch.

23. The drying rack of claim 22 wherein the frame includes a center column positioned along a center of the frame, the side wall including a center notch to prevent interference between the center column and at least one of the first drip tray and the second drip tray.

* * * * *